US009696663B2

(12) United States Patent
Noguchi et al.

(10) Patent No.: US 9,696,663 B2
(45) Date of Patent: Jul. 4, 2017

(54) IMAGE FORMING APPARATUS

(71) Applicant: CANON KABUSHIKI KAISHA, Tokyo (JP)

(72) Inventors: Bunro Noguchi, Mishima (JP); Yoshihiro Mitsui, Numazu (JP); Hisashi Taniguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/077,054

(22) Filed: Mar. 22, 2016

(65) Prior Publication Data

US 2016/0291523 A1 Oct. 6, 2016

(30) Foreign Application Priority Data

Mar. 31, 2015 (JP) ..... 2015-071911

(51) Int. Cl.
*G03G 15/16* (2006.01)
*G03G 21/00* (2006.01)

(52) U.S. Cl.
CPC ..... *G03G 15/161* (2013.01); *G03G 21/0005* (2013.01); *G03G 21/0064* (2013.01)

(58) Field of Classification Search
CPC ..... G03G 15/161; G03G 21/0005; G03G 2215/1647; G03G 2221/0005; G03G 15/166; G03G 21/0064
USPC ..... 399/71, 101, 129, 343
See application file for complete search history.

(56) References Cited

U.S. PATENT DOCUMENTS 6,070,047 A * 5/2000 Ichinose ..... G03G 15/161 399/174
2009/0232530 A1 9/2009 Saito et al.
2011/0286755 A1* 11/2011 Okano ..... G03G 21/0005 399/71 X
2012/0321329 A1* 12/2012 Yoshida ..... G03G 15/0131 399/38
2014/0105643 A1 4/2014 Saito et al.
2014/0153946 A1* 6/2014 Kobayashi ..... G03G 15/1605 399/66
2015/0234312 A1* 8/2015 Funayama ..... G03G 15/065 399/55

(Continued)

FOREIGN PATENT DOCUMENTS

JP H09-50167 A 2/1997
JP 2009-205012 A 9/2009

OTHER PUBLICATIONS

U.S. Appl. No. 15/077,072, filed Mar. 22, 2016.

*Primary Examiner* — Sophia S Chen

(74) *Attorney, Agent, or Firm* — Fitzpatrick, Cella, Harper & Scinto

(57) ABSTRACT

Provided is an image forming apparatus in which an electrostatic latent image is developed using developer to which externally added particles have been added. In the image forming apparatus, a cleaning operation in which the developer borne by an intermediate transfer member is transferred to an image bearing member and removed from the surface of the image bearing member with a cleaning member can be executed in a non-image-formation period in which the development of the electrostatic latent image is not performed. The image bearing member is in contact with a developer bearing member and the intermediate transfer member at least within a period in which the cleaning operation is executed within the non-image-formation period.

19 Claims, 6 Drawing Sheets

(56) References Cited

U.S. PATENT DOCUMENTS

2015/0301497 A1* 10/2015 Kawanami ..... G03G 21/168
399/121

* cited by examiner

IMAGE FORMING APPARATUS

BACKGROUND OF THE INVENTION

Field of the Invention

The present invention relates to an image forming apparatus of an electrophotographic system or electrostatic recording system.

Description of the Related Art

A well-known conventional image forming apparatus of an inline color system, such as a laser beam printer, has a configuration in which a plurality of image bearing members are arranged side by side in the rotation direction of an intermediate transfer member. In such an image forming apparatus, a photosensitive drum serving as the image bearing member is uniformly charged with charging means, a toner image is developed with developing means at an electrostatic latent image formed on the photosensitive drum by an exposure device, and the toner image is primary transferred onto the intermediate transfer member. A full-color toner image is then formed on the intermediate transfer member by repeating the same primary transfer with a plurality of colors. Then, the full-color toner image is secondary transferred onto a recording material, and the full-color tone image is permanently fixed to the recording material with fixing means. In this case, the so-called mono-component contact development is used as the developing means. When the image is formed, the electrostatic latent image on the photosensitive drum is developed by bringing a developing roller serving as a developer bearing member into contact with the photosensitive drum. In the non-image-formation period, the developing roller is separated from the photosensitive drum.

The toner (untransferred toner) which has not been transferred onto the transfer material in the secondary transfer process and remains on the intermediate transfer member needs to be removed from the intermediate transfer member. Accordingly, the so-called transfer-synchronized collection system has been suggested for removing the untransferred toner from the intermediate transfer member (see Japanese Patent Application Publication No. H9-50167). Thus, the untransferred toner present on the intermediate transfer member is retransferred to the photosensitive drum during the next primary transfer process by charging the toner to a polarity reversed with respect to that of the regular charged state of the toner with the toner charging means. The toner retransferred to the photosensitive drum is removed with cleaning means such as a cleaning blade.

Further, a method using an electrically conductive brush member and an electrically conductive roller member has been suggested for collecting the untransferred toner present on the intermediate transfer member (referred to hereinbelow, as secondary untransferred toner (Japanese Patent Application Publication No. 2009-205012). More specifically, mechanical scattering, primary collection, and charging of the secondary untransferred toner present on the intermediate transfer member are performed by applying a DC voltage to the brush member.

With such a configuration, the collection can be performed simultaneously with the primary transfer to the next page and the images can be continuously formed without reducing the printing speed. The secondary untransferred toner on the very last page in a series of continuous printing operations is collected with the cleaning blade of the photosensitive drum in the non-image-formation period. The primary collected toner retained at the brush member is then released onto the intermediate transfer member by alternately applying positive and negative voltage to the brush member. Where the amount of the primary collected toner at the brush member is large, as in the case of large number of successive continuous printing operations, the printing is interrupted to obtain a non-image-formation state in order to maintain the toner charging performance of the brush member. The toner accumulated at the brush member is then released. Since such collection of the secondary untransferred toner from the very last page and the collection of the toner by releasing the toner from the brush member are performed in the non-image-formation period, those collection operations are performed when the photosensitive drum and developing roller are separated from each other.

SUMMARY OF THE INVENTION

However, in the above-described configuration, the toner which has been retransferred from the intermediate transfer member to the photosensitive drum is not cleaned by the cleaning blade of the photosensitive drum, and vertical black stripes can be formed on the image. In particular, where the toner is collected from the intermediate transfer member when the developing roller is separated from the photosensitive drum in the non-image-formation period, vertical black stripes caused by faulty cleaning easily appear on the image.

This phenomenon occurs because the so-called toner external additive (particles which are added as auxiliary particles to the toner particles, or externally added particles) migrating from the developing roller to the photosensitive drum is lost as a result of separating the developing roller from the photosensitive drum in the non-image-formation period. Where the toner external additive is not supplied to the edge portion of the cleaning blade, the toner external additive layer (referred to hereinbelow as "blocking layer") which is formed at the edge portion of the cleaning blade and serves as a barrier is eliminated and faulty cleaning easily occurs.

It is an objective of the present invention to provide a technique which can reduce the occurrence of image defects caused by lack of the externally added particles in the contact portion of the image bearing member and cleaning member.

In order to attain the abovementioned objective, the present invention provides an image forming apparatus, comprising:

- a developer bearing member that bears developer to which externally added particles have been added;
- an image bearing member that is in contact with the developer bearing member and on which an electrostatic latent image formed on a surface of the image bearing member is developed;
- an intermediate transfer member to which a developer image developed on the surface of the image bearing member is transferred; and
- a cleaning member that is in contact with the image bearing member and cleans the surface of the image bearing member,
- the developer bearing member and the image bearing member being configured to be separable in a non-image-formation period in which the development of the electrostatic latent image is not performed, and
- a cleaning operation, in which the developer borne by the intermediate transfer member is transferred to the image bearing member and removed from the surface of the image bearing member with the cleaning member, being able to be executed in the non-image-formation period, wherein the image bearing member is in contact with the developer bearing member and the intermediate transfer member at least within a period in which the cleaning operation is executed within the non-image-formation period.

Further features of the present invention will become apparent from the following description of exemplary embodiments (with reference to the attached drawings).

DESCRIPTION OF THE EMBODIMENTS

The modes for carrying out the invention will be explained hereinbelow in greater detail on the basis of embodiments thereof with reference to the appended drawings. The dimensions, materials, shapes, and mutual arrangement of constituent parts described in the embodiments are to be changed, as appropriate, according to the configuration of the apparatus using the invention and various conditions relating thereto. Thus, the scope of the invention is not intended to be limited to the below-described embodiments.

(Embodiment 1)

The specific feature of the embodiment of the present invention is that the developing roller is brought into contact with the photosensitive drum when the toner is released from the toner charging brush mounted on the intermediate transfer member in the non-image-formation period. As a result, the toner external additive is delivered to the edge portion of the cleaning blade and a blocking layer is formed, thereby making it possible to prevent the occurrence of faulty cleaning.

Figure 1:
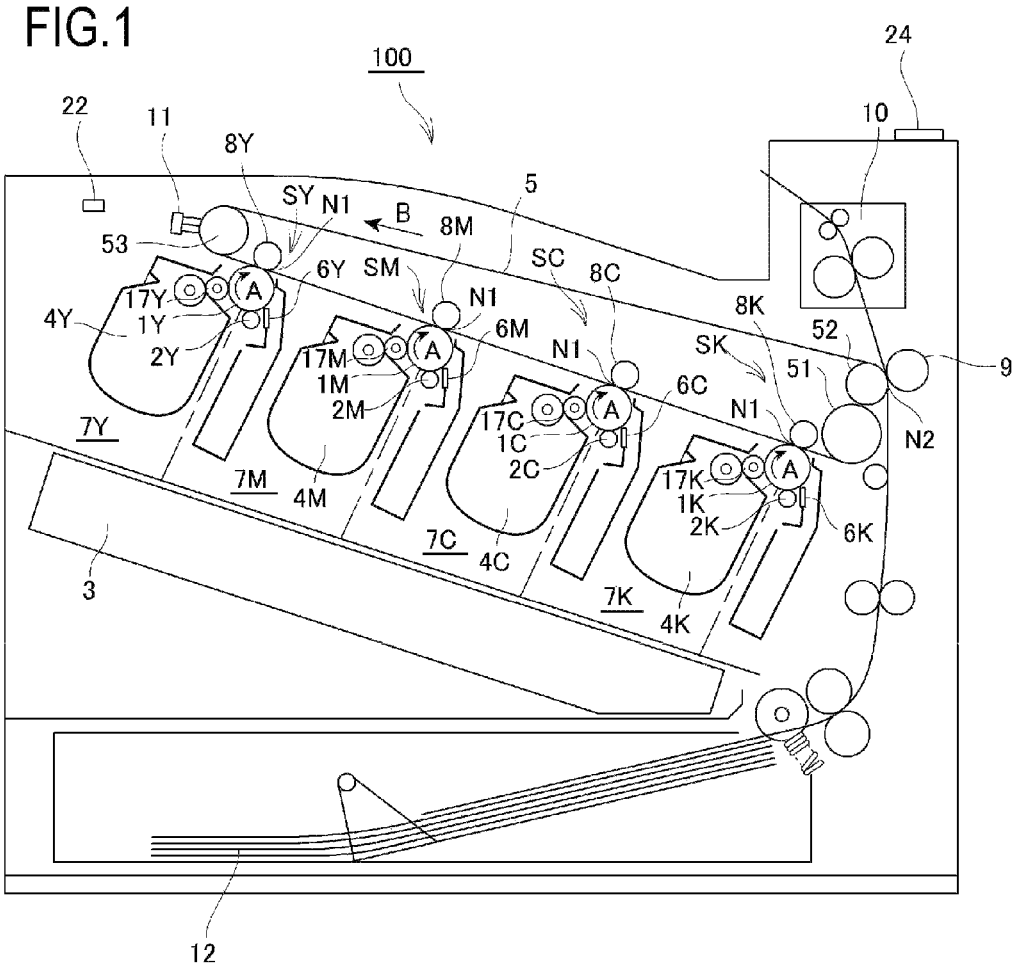
FIG. 1 is an explanatory drawing illustrating the image forming apparatus of the embodiment.

(1) Brief Description of the Configuration and Operation of the Image Forming Apparatus The entire configuration of an electrophotographic image forming apparatus (image forming apparatus) of the embodiment of the present invention will be explained hereinbelow with reference to FIG. 1. FIG. 1 is a schematic cross-sectional view of an image forming apparatus 100 of the present embodiment. The image forming apparatus 100 of the present embodiment is a full-color laser printer using an in-line system and an intermediate transfer system. The image forming apparatus 100 can form a full-color image on a recording material (for example, recording paper). Image information is input to the main body of the image forming apparatus from an image reading device connected to the main body of the image forming apparatus, or from a host device such as a personal computer communicatively connected to the main body of the image forming apparatus.

The image forming apparatus 100 has first, second, third, and fourth image forming portions SY, SM, SC, and SK for forming images of yellow (Y), magenta, (M), cyan (C), and black (K) colors as a plurality of image forming portions. In the present embodiment the first to fourth image forming portions SY, SM, SC, and SK are arranged in a row along the direction crossing the vertical direction. In the present embodiment, the configurations and operation of the first to fourth image forming units are substantially the same, except for the difference in color of the image to be formed. Therefore, in the comprehensive explanation hereinbelow, the subscripts Y, M, C, and K provided with the reference numerals to represent the color associated with the component will be omitted, unless specific distinction therebetween is required.

Thus, in the present embodiment, the image forming apparatus 100 has four drum-shaped electrophotographic photosensitive members, that is, photosensitive drums 1, which are arranged side by side in the direction crossing the vertical direction, as a plurality of image bearing members. The photosensitive drums 1 are rotationally driven by driving means (drive source; not depicted in the figures) in the direction indicated by an arrow A in the figure (clockwise direction). A charging roller 2 as charging means for uniformly charging the surface of the photosensitive drum 1, and a scanner unit (exposure device) 3 as exposure means for irradiating with a laser on the basis of image information and forming an electrostatic image (electrostatic latent image) on the photosensitive drum 1 are arranged on the periphery of the photosensitive drum 1. Further, a developing unit (developing assembly) 4 as developing means for developing the electrostatic image as a toner image, and a cleaning blade 6 as cleaning means for removing the toner (untransferred toner) remaining on the surface of the photosensitive drum 1 after the transfer are also arranged on the periphery of the photosensitive drum 1. An intermediate transfer belt 5 as an intermediate transfer member for transferring the toner image located on the photosensitive drum 1 to a recording material 12 is arranged opposite the four photosensitive drums 1.

In the present embodiment, the photosensitive drum 1 and the charging roller 2, developing unit 4, and cleaning blade 6, which serve as process means operating with the photosensitive drum 1, are integrated as a process cartridge 7. The process cartridges 7 are detachably mounted on the apparatus main body of the image forming apparatus 100. The apparatus main body, as referred to herein, indicates a constituent part of the configuration of the image forming apparatus 100 other than the detachable components, such as the process cartridges 7. In the present embodiment, the process cartridges 7 of each color have the same shape, and toners of yellow (Y), magenta (M), cyan (C), and black (K) colors are housed in the process cartridges 7 of respective colors.

The intermediate transfer belt 5, which is formed as an endless belt serving as the intermediate transfer member, rotates in the direction indicated by an arrow B in the figure (counterclockwise direction) in contact with all of the photosensitive drums 1. The intermediate transfer belt 5 is stretched over a driver roller 51, a secondary transfer opposing roller 52, and a driven roller 53 as a plurality of support members. Four primary transfer rollers 8 are arranged side by side as primary transfer means such as to face each photosensitive drum 1 on the inner circumferential surface side of the intermediate transfer belt 5, and a primary transfer nip N1 is formed in the contact portion of each photosensitive drum 1 and the intermediate transfer belt 5. Further, a bias of a polarity opposite to the regular charging polarity of the toner is applied from a primary transfer bias power source (not depicted in the figure) to the primary transfer roller 8. As a result, the toner image located on the photosensitive drum 1 is transferred onto the intermediate transfer belt 5 in each primary transfer nip N1. A secondary transfer roller 9 serving as secondary transfer means is disposed at a position facing the secondary transfer opposing roller 52 on the outer circumferential surface side of the intermediate transfer belt 5, and a secondary transfer nip N2 is formed in the contact portion of the intermediate transfer belt 5 and the secondary transfer roller 9. A bias of a polarity opposite to the regular charging polarity of the toner is applied from a secondary transfer bias power source (not depicted in the figure) to the secondary transfer roller 9. As a result, the toner image located on the intermediate transfer belt 5 is transferred onto the recording material 12 in each secondary transfer nip N2.

During image formation, the surface of the photosensitive drum 1 is initially uniformly charged by the charging roller 2. Then, an electrostatic image (electrostatic latent image) corresponding to the image information supplied from the scanner unit 3 is formed on the photosensitive drum 1 by a laser beam corresponding to the image information. The electrostatic image is then developed as a toner image (developer image) by the developing unit 4 and transferred (primary transferred) on the intermediate transfer belt 5 by the action of the primary transfer roller 8.

For example, when a full-color image is formed, the above-described process is sequentially performed in the first to fourth image forming portions SY, SM, SC, and SK, and toner images of respective colors are successively combined on the intermediate transfer belt 5. The four-color toner image on the intermediate transfer belt 5 is then secondary transferred as a whole onto the recording material 12. The toner image is then fixed by the fixing apparatus 10 by applying heat and pressure to the recording material 12. The primary untransferred toner remaining on the photosensitive drum 1 after the primary transfer process is removed and collected by the cleaning blade 6.

The secondary untransferred toner remaining on the intermediate transfer belt 5 after the secondary transfer process is charged by a toner charging brush 11 (charging member) with a charge of a polarity opposite to the regular charge polarity of the toner. The secondary untransferred toner charged by the toner charging brush 11 is transferred onto the photosensitive drum 1Y of the first image forming portion and collected by the cleaning blade 6 in the next primary transfer process.

[Process Cartridge]

Figure 2:
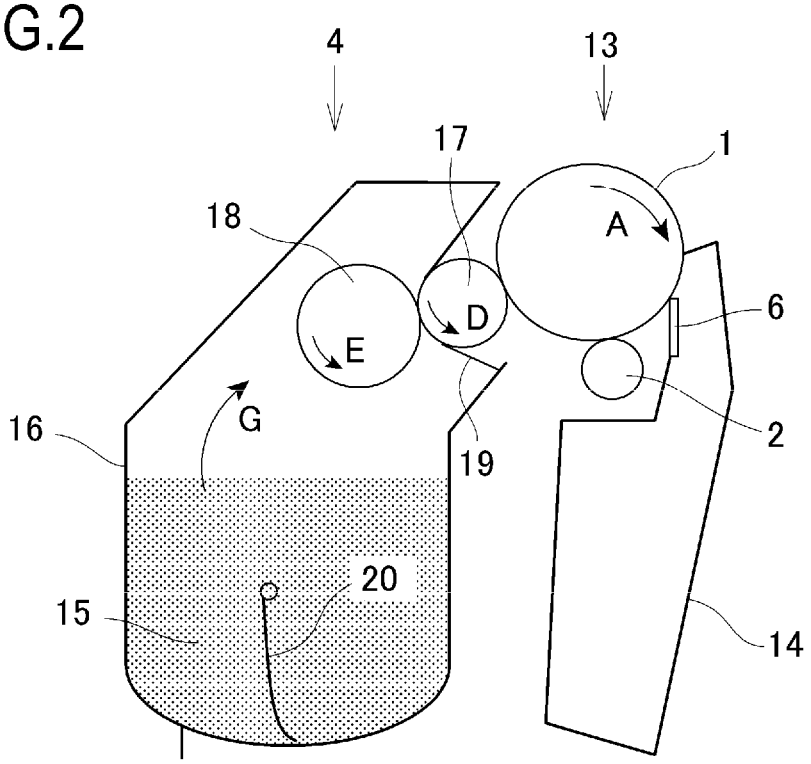
FIG. 2 is an explanatory drawing illustrating a process cartridge of the embodiment.

The entire configuration of the process cartridge 7 which is mounted on the image forming apparatus 100 of the present embodiment will be explained hereinbelow with reference to FIG. 2. FIG. 2 is a schematic cross-sectional view of the process cartridge 7 of the present embodiment, which is viewed from the longitudinal direction (rotation axis direction) of the photosensitive drum 1. In the present embodiment, the configuration and operation of the process cartridges 7 of all colors are the same, except for the type (color) of the developer housed therein. The process cartridge 7 has a photosensitive unit 13 (first unit) provided with the photosensitive drum 1, and a developing unit 4 (second unit) provided with the developing roller 17 (developer bearing member).

The photosensitive unit 13 has a cleaning frame 14 serving as a frame for supporting the elements located inside the photosensitive unit 13. The photosensitive drum is rotatably mounted through a bearing (not depicted in the figure) on the cleaning frame 14. The photosensitive drum 1 is rotationally driven in the direction indicated by the arrow A in the figure (clockwise direction) in response to the image forming operation when drive power of a drive motor serving as driving means (driving source; not depicted in the figure) is transmitted to the photosensitive unit 13. The photosensitive drum 1 which plays a central role in the image forming process uses an organic photosensitive member obtained by successively coating an underlayer in the form of a functional film, a carrier generating layer, and a carrier transport layer on the outer circumferential surface of an aluminum cylinder. The cleaning blade 6 and the charging roller 2 are arranged in the photosensitive unit 13 such as to be in contact with the circumferential surface of the photosensitive drum 1. The untransferred toner removed by the cleaning blade 6 from the surface of the photosensitive drum 1 is collected upon falling down inside the cleaning frame 14.

The charging roller 2, which is charging means, is rotationally driven by pressing the roller portion of an electrically conductive rubber against the photosensitive drum 1. A predetermined DC voltage with respect to the photosensitive drum 1 is applied in the charging process to the core of the charging roller 2, thereby forming a uniform dark potential (Vd) on the surface of the photosensitive drum 1. Laser exposure is implemented on the photosensitive drum by the spot pattern of the laser beam emitted according to the image data from the aforementioned scanner unit 3, surface charges in the exposed segment are lost under the effect of carriers from the carrier generating layer, and the electric potential drops. As a result, an electrostatic latent image in which the exposed segment is under a predetermined light potential (V1) and the non-exposed segment is under the predetermined dark potential (Vd) is formed on the photosensitive drum 1.

Meanwhile, the developing unit 4 is constituted by a developing roller 17, a developing blade 19, a toner supply roller 18, a toner 15, and a toner housing chamber 16 where the toner is accommodated. A nonmagnetic spherical toner with a particle size of 7 μm which is charged to a negative polarity as a regular polarity is used as the toner 15 (developer). Further, silica particles (externally added particles) with a diameter of 20 nm are added as a toner external additive to the surface of the toner 15.

The developing blade 19 is brought into contact with the developing roller by a counter to regulate the coating amount of the toner supplied by the toner supply roller and apply electric charges. The developing blade 19 is constituted by a thin plate-shaped member, a contact pressure is formed using the spring elasticity of the thin plate, and the surface thereof is brought into contact with the toner and the developing roller 17. The toner is triboelectrically charged as the developing blade 19 rubs against the developing roller 17, and at the same time the layer thickness thereof is regulated. In the present embodiment, a predetermined voltage is applied to the developing blade 19 from a blade bias power source (not depicted in the figure), and the toner coating is stabilized.

The developing roller 17 and the photosensitive drum 1 rotate such that the surfaces thereof in the opposing portions (contact portions) move in the same direction (in the present embodiment, the direction indicated by arrows A and D, which is the upward direction). In the present embodiment, the toner which has been triboelectrically charged negatively with respect to the predetermined DC bias applied to the developing roller 17 is transferred only to the light potential zones and visualizes the electrostatic latent image due to this difference in potential in the developing portion which is in contact (sliding contact) with the photosensitive drum 1.

The toner supply roller 18 is provided such as to form a predetermined nip portion on the circumferential surface of the developing roller 17 and rotates in the direction of an arrow E in the figure (counterclockwise direction). The toner supply roller 18 is an elastic sponge roller in which a foamed body is formed on the outer circumference of an electrically conductive core. The toner supply roller 18 and the developing roller 17 are in contact with each other at a predetermined penetration level. The two rollers rotate such as to move in the mutually opposite directions in the contact portion, and such operation ensures the supply of the toner to the developing roller by the toner supply roller 18 and the stripping of the toner from the developing roller which has remained as a development residue.

A toner stirring member 20 is provided inside the toner housing chamber 16. The toner stirring member 20 serves to stir the toner housed inside the toner housing chamber 16 and convey the toner to above the toner supply roller 18 in the direction indicated by an arrow G in the figure. In the present embodiment, the developing roller 17 and the toner supply roller 18 each have a diameter of 20 mm, and the penetration level of the toner supply roller 18 into the developing roller 17 is set to 1.5 mm. In the present embodiment, a predetermined DC bias is applied to the developing roller 17, and in the development portion which is in contact with the photosensitive drum 1, the electrostatic latent image is visualized by the movement of the toner only to the light potential portion as a result of this difference in potential.

[Developing Roller Contact-separation Mechanism]

Figure 3:
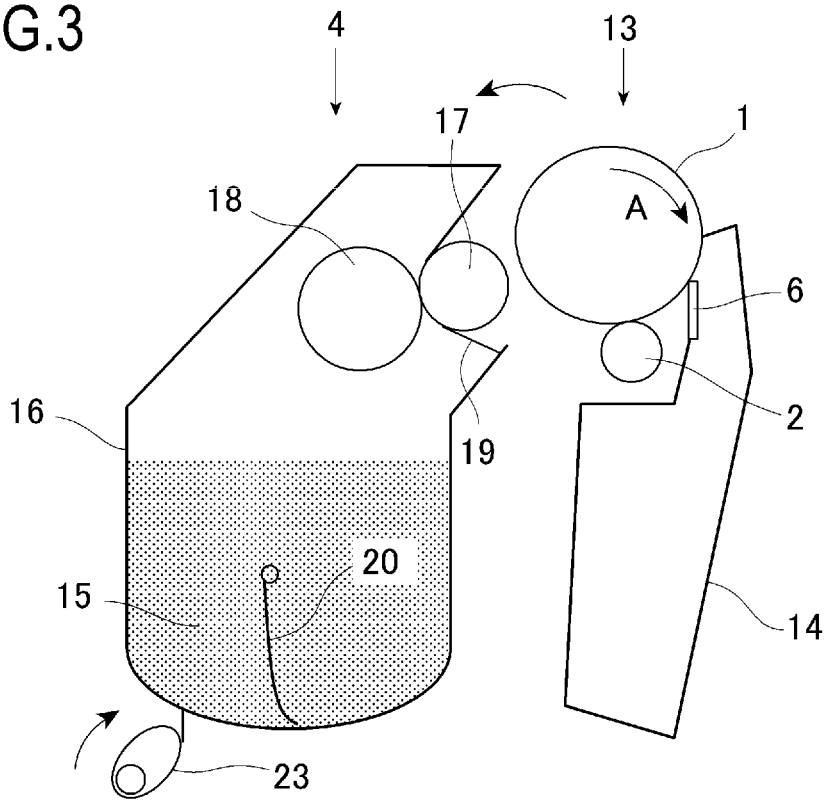
FIG. 3 is an explanatory drawing illustrating the process cartridge at the time of developing roller separation in the embodiment.

FIG. 3 is a schematic cross-sectional view of the process cartridge 7 of the present embodiment, this view illustrating the state in which the developing roller 17 is separated from the photosensitive drum 1. The developing roller 17 is configured to enable the contact with and separation from the photosensitive drum 1 and controlled to be in contact during image formation and to be separated, as depicted in FIG. 3, and to stop the developing roller drive in the non-image-formation period. During image formation, as referred to herein, is a period in which a developer image is formed by transferring the developer from the developing roller 17 according to the electrostatic latent image which has been formed on the photosensitive drum 1. The non-image-formation period is a period in which the aforementioned developer image is not formed. For example, it is a period after the developer image has been formed on the photosensitive drum 1, after the image formation performed before the photosensitive drum 1 is stopped (referred to hereinbelow as "post-rotation"), or before the image formation in which the formation of the developer image is started after the rotation of the photosensitive drum 1 has been started (referred to hereinbelow as "ante-rotation"). Further, specifically provided periods in which the developer image is not formed, such as a period corresponding to the period between the recording materials when a plurality of recording materials 12 are conveyed during continuous printing, a period in which the operation of image density adjustment is performed, and a period in which the operation of releasing the toner adhered to the toner charging brush is performed, are also the non-image-formation periods.

The configuration including a cam 23 that is provided at the image forming apparatus 100 and can control the rotation position and a spring member (not depicted in the figure) that is provided at the process cartridge 7 and applies pressure such that the developing roller 17 and the photosensitive drum 1 are in contact with each other represent a specific example of the contact-separation mechanism. The developing roller contact state is obtained when the cam 23 controls the developing unit 4 to a position without pressure application and a contact state is assumed under a pressurizing force applied by the spring member of the process cartridge 7. The developing roller separation state is obtained when the developing unit 4 is pushed from the bottom and rotated by controlling the rotation position of the cam 23. The operations of various components of the image forming apparatus 100 are controlled by controlling the drive source, such as a motor, with a control unit (CPU) provided at the apparatus main body.

The contact-separation mechanism for separating the developing roller 17 and the photosensitive drum 1 from each other is not limited to that using the above-described cam and spring member, and the cam alone can be used, provided that the contact and separation can be controlled.

[Intermediate Transfer Belt]

A polyvinylidene fluoride film with a thickness of 100 μm and a volume resistivity adjusted to $10^{11}$ Ωcm is used as the intermediate transfer belt 5. Further, the intermediate transfer belt 5 is stretched over three shafts, namely, the driver roller 51, the secondary transfer opposing roller 52, and the driven roller 53.

[Primary Transfer Roller]

An elastic roller with a volume resistivity of $10^5$ Ωcm to $10^9$ Ωcm and a rubber hardness of 30° (Asker C hardness meter) is used as the primary transfer roller 8. The primary transfer roller 8 is pressed against the photosensitive drum 1, with the intermediate transfer belt 5 being interposed therebetween, under a total pressure of about 9.8 N. Further, the primary transfer roller 8 rotates following the rotation of the intermediate transfer belt 5. A voltage of −2.0 kV to 3.5 kV can be applied to the primary transfer roller 8 from a primary transfer power source (not depicted in the figure).

[Toner Charging Brush]

A brush member configured such that Nylon fibers with a conductivity of $10^6$ Ωcm to $10^9$ Ωcm are arranged substantially densely therein is used and fixedly arranged as the toner charging brush 11. In the present embodiment, the tip position of the toner charging brush 11 is set such that the penetration level with respect to the surface of the intermediate transfer belt 5 is 1.0 mm. The toner charging brush 11 positioned on the upstream side in the movement direction of the surface of the intermediate transfer belt 5 rubs against the surface of the intermediate transfer belt 5 following the movement of the intermediate transfer belt 5. The toner charging brush 11 is disposed downstream of the secondary transfer unit and upstream of the first image forming portion in the movement direction of the intermediate transfer belt 5. Further, a voltage of −2.0 kV to +2.0 kV can be applied to the toner charging brush 11 from a high-voltage power source (not depicted in the figure) serving as toner charging brush voltage supply means.

(2) Explanation of Operations Performed when Secondary Untransferred Toner is Collected

[Secondary Untransferred Toner Collection Method]

A secondary untransferred toner collection method serving as a cleaning operation performed during printing will be explained hereinbelow in detail. After the secondary transfer process, the secondary untransferred toner remains on the intermediate transfer belt 5. Accordingly, a bias of a polarity opposite to the regular charge polarity of the toner, in the present embodiment, a bias of +1.5 kV of a positive polarity is applied to the toner charging brush 11. As a result, when the toner that could not be collected with the cleaning blade of the intermediate transfer member passes by the toner charging brush 11, the toner is charged to a positive polarity. Further, at this time, the toner with a negative polarity which could not be charged to a positive polarity is partially held at the toner charging brush 11. The toner which has been provided with charges of a positive polarity by the toner charging brush 11 is retransferred to the photosensitive drum 1Y of the first image forming portion in the primary transfer process and collected by the cleaning blade 6. Further, the control is performed such that the secondary untransferred toner of the final page in continuous printing is collected to the photosensitive drum 1Y of the first image forming portion in the non-image-formation period.

[Toner Charging Brush Release Process]

A process for releasing the toner from the toner charging brush 11, which is a cleaning operation, will be explained hereinbelow in detail. As mentioned hereinabove, the toner of a negative polarity which could not be charged to a positive polarity with the toner charging brush 11 is temporarily held at the toner charging brush 11. Therefore, where the image formation operation is repeatedly performed, the toner accumulates at the toner charging brush 11, the electric resistance thereof rises, and charging performance at the toner charging brush 11 is degraded. Therefore, a process for releasing the toner held at the toner charging brush 11 to the intermediate transfer belt 5 is needed. In the present embodiment, the release process is performed during post-rotation, but a period for performing the release process may be also provided separately from the printing period.

Since the toner which is to be released is of a negative polarity and has the same polarity as the toner during the development, this process cannot be realized by transferring the toner to the photosensitive drum 1 in the primary transfer unit during image formation. For this reason, a bias of the same polarity as the regular charge polarity of the toner, in the present embodiment, a bias of −1.5 kV of a negative polarity, is applied to the toner charging brush 11 in the post-rotation process in the non-image-formation period and the toner of a negative polarity is released to the intermediate transfer belt 5. Further, as a result of applying a bias of −1.5 kV of the same polarity as the regular charge polarity of the toner to the primary transfer roller in the first image forming portion, the toner is retransferred to the photosensitive drum 1Y and collected by the cleaning blade 6. This process is performed with a period of 100 printing operations.

(3) Explanation of Specific Feature of the Present Embodiment

The specific feature of the present embodiment is that the developing roller 17 is brought into contact with the photosensitive drum 1 in the process of releasing the toner from the toner charging brush 11 which is performed in the aforementioned non-image-formation period. The cleaning performance was compared when actually performing the release process.

Figure 4:
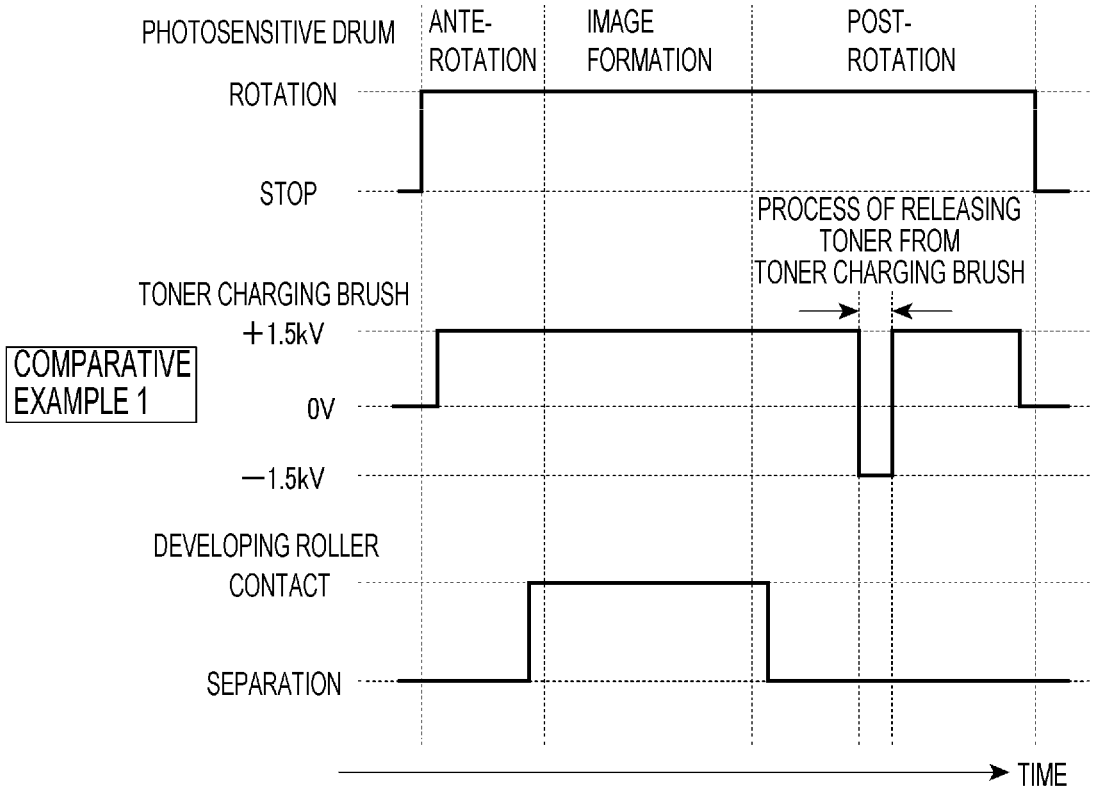
FIG. 4 is an explanatory drawing illustrating the developing roller separation timing in Embodiment 1 and Comparative Example 1.
Figure 4:
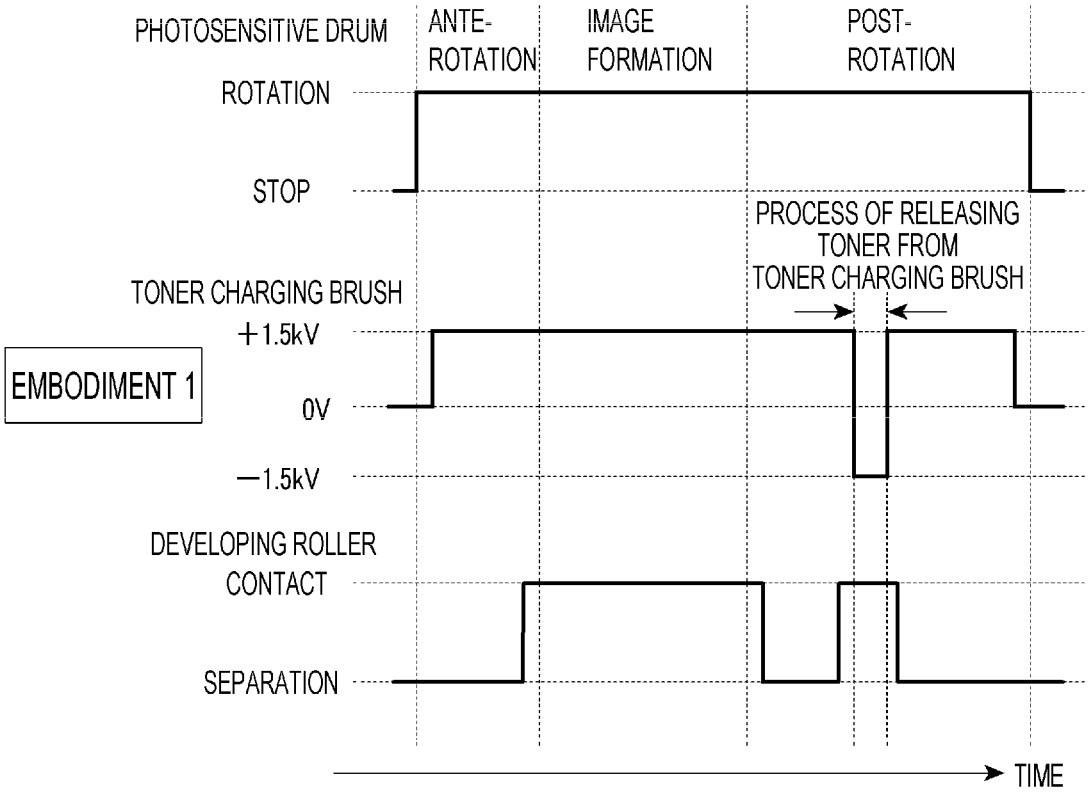

FIG. 4 shows timings at which the photosensitive drum 1Y is rotated and stopped and a positive or negative bias is applied to the toner charging brush 11, and timings at which the developing roller 17Y is brought into contact and separated in Comparative Example 1 and Embodiment 1. As depicted in FIG. 4, the rotation and stop timing of the photosensitive drum 1Y and the timing at which the bias applied to the toner charging brush 11 is changed from +1.5 kV to −1.5 kV in the process of releasing the toner from the toner charging brush 11 in the post-rotation are the same in Comparative Example 1 and Embodiment 1. However, the contact-separation state of the developing roller 17Y and the photosensitive drum 1Y in the process of releasing the toner from the toner charging brush 11 is different. In Comparative Example 1, the developing roller 17Y and the photosensitive drum 1Y are separated immediately after the image formation has ended, and the printing is ended in this state. Meanwhile, in Embodiment 1, the developing roller 17Y is temporarily separated immediately after the image formation has ended, but the developing roller 17Y is brought into contact with the photosensitive drum 1Y immediately before the process of releasing the toner from the toner charging brush 11. Further, the control is performed to ensure the separation after the release process has ended. Thus, in the present embodiment, the state in which the developing roller 17 is in contact with the photosensitive drum 1 (and the intermediate transfer belt 5) is assumed at least within a period in which the process of releasing the toner from the toner charging brush 11 is executed within the non-image-formation period. In the present embodiment, the state in which the developing roller 17 is in contact with the photosensitive drum 1 (and the intermediate transfer belt 5) is assumed both before and after the execution period of the process of releasing the toner from the toner charging brush 11.

As common conditions, image defects (vertical black stripes) were checked when a horizontal linear image with a printing ratio of 5% of each color was continuously printed 100 times, then a process of releasing the toner from the toner charging brush 11 was performed, and a yellow half-tone image with a printing ratio of 25% was printed immediately thereafter. The installation environment of the image forming apparatus 100 was a low-temperature low-humidity environment (temperature 15° C., humidity 10%) which was severe in terms of faulty cleaning.

TABLE 1

Faulty cleaning results in release collection process

| | Contact state of developing roller and photosensitive drum | Occurrence of vertical black stripes caused by faulty cleaning |
|---|---|---|
| Comparative Example 1 | Separation | Yes |
| Embodiment 1 | Contact | No |

As indicated in Table 1, vertical black stripes caused by faulty cleaning appeared in Comparative Example 1, but in the configuration of Embodiment 1, no faulty cleaning has occurred. This is because as a result of bringing the developing roller 17 into contact with the photosensitive drum 1, the external additive directly migrates to the photosensitive drum 1 and is supplied to the edge portion of the cleaning blade 6 from the fog toner which has migrated to the photosensitive drum 1 and from the toner coated on the developing roller 17. The external additive also migrates to the photosensitive drum 1 from the fog toner which has migrated from the developing roller 17 to the photosensitive drum 1, and the migrated external additive is supplied to the edge portion of the cleaning blade 6. The supplied external additive forms a blocking layer acting as a barrier layer on the edge portion of the cleaning blade and improves the cleaning performance.

Figure 5:
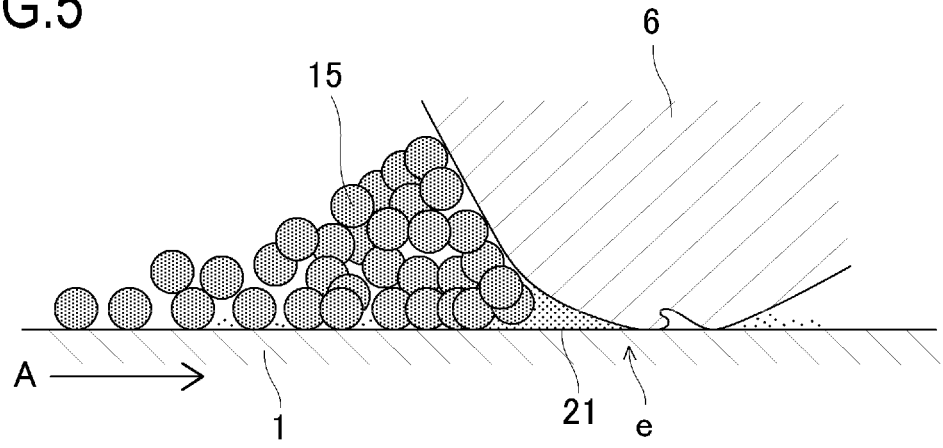
FIG. 5 is an enlarged view of a cleaning blade edge portion in Embodiment 1.

The mechanism of cleaning performance improvement will be explained hereinbelow by using an enlarged section of the edge portion of the cleaning blade depicted in FIG. 5. The cleaning blade 6 is a blade member extending in the direction opposite to the rotation direction of the photosensitive drum 1. In the configuration depicted in FIG. 5, the cleaning blade 6 comes into contact in the direction opposite to the rotation direction of the photosensitive drum 1. Thus, the edge portion (e) which is the tip extending in the direction opposite to the movement direction of the photosensitive drum 1 with respect to the cleaning blade 6 is in contact with the surface of the photosensitive drum 1. Therefore, following the rotation of the photosensitive drum 1, the edge portion (e) of the cleaning blade 6 is warped in the movement direction of the photosensitive drum 1. The aforementioned toner external additive that has migrated to the photosensitive drum 1 is retained in the warped wedge-shaped portion (contact portion) and forms a layer (referred to hereinbelow as "blocking layer 21").

Where the toner is to be cleaned in a state in which the blocking layer 21 has not been formed, the toner easily slips in from the warped wedge-shaped portion of the edge, and faulty cleaning easily occurs. Where the blocking layer 21 is present at the edge portion of the cleaning blade, as depicted in FIG. 5, the toner is prevented from slipping in and the cleaning performance is improved. Meanwhile, since the blocking layer 21 is formed by the toner external additive with a size of about 20 nm, a predetermined amount of the external additive is regularly taken out from the edge portion of the cleaning blade and lost. Therefore, where the developing roller 17 separates from the photosensitive drum 1 and the supply of the external additive to the edge portion of the cleaning blade is stopped, the blocking layer 21 is gradually lost, which results in the degradation of cleaning performance.

Increasing the time of contact of the developing roller 17Y with the photosensitive drum 1Y can easily be effective because a sufficient blocking layer can be produced. In particular, the effect of the present embodiment can be readily demonstrated when the external additive from the developing roller 17 is supplied to the cleaning blade 6 until before the secondary untransferred toner from the intermediate transfer belt 5 is collected by the cleaning blade 6.

As explained hereinabove, with the configuration of the present embodiment, the occurrence of a vertical black stripe image caused by faulty cleaning can be prevented even when the toner is collected in the non-image-formation period.

Further, in the present embodiment, only the developing roller 17Y is brought into contact with the photosensitive drum 1Y in the release process within the non-image-formation period immediately after the image formation process, but such timing of contact and image forming portion are not limiting. In other words, the developing roller 17 and the photosensitive drum 1 may be brought into contact with each other when the toner is collected at the photosensitive drum 1 and faulty cleaning can occur within the non-image-formation period at a timing other than that of the release process, for example, in the toner density adjustment process or color distortion correction process. Further, in the configuration of the present embodiment, the toner released from the toner charging brush 11 is collected by the first image forming portion which is the closest to the toner charging brush 11 in the rotation direction of the intermediate transfer belt 5, but the toner may be also collected by an image forming portion other than the first image forming portion.

Whether or not to provide the operation panel (operation portion) 24 (see FIG. 1), which allows the user to set (control) the operation contents of the image forming apparatus, on the apparatus main body and to perform the control of bringing the developing roller 17 into contact with the photosensitive drum 1, as in the present embodiment, may be selected by the user. Thus, a non-contact mode (first mode) in which the developing roller 17 is not brought into contact with the photosensitive drum 1 and a contact mode (second mode) in which the developing roller 17 is brought into contact with the photosensitive drum 1 may be executed selectively. Further, by performing the control of bringing the developing roller 17 into contact with the photosensitive drum 1 only when the user has recognized an image caused by faulty cleaning, it is possible to prevent parts, such as the developing roller 17, and the toner from excessive degradation caused by the rotation of the developing roller 17.

Further, a temperature sensor (temperature detection portion) 22 (see FIG. 1) that detects the temperature at the location of the image forming apparatus may be provided at the apparatus main body, and the control of bringing the developing roller 17 into contact with the photosensitive drum 1 may be performed only when it is detected that the image forming apparatus 100 is at a temperature equal to or lower than a predetermined temperature. Faulty cleaning is liable to occur in a low-temperature environment in which the rubber elastic modulus of the cleaning blade decreases and the ability of the cleaning blade to follow the photosensitive drum is degraded. Therefore, by performing the control of the present embodiment, for example, only when a temperature of 20° C. or less is detected, it is possible to prevent parts, such as the developing roller 17, and the toner from excessive degradation caused by the rotation of the developing roller 17.

Further, when the control of bringing the developing roller 17 into contact with the photosensitive drum 1, such as that of the present embodiment, is performed, the rotation speed of the developing roller 17 may be decreased to be equal, for example, to that of the photosensitive drum 1. As a result, the rotation speed of the developing roller 17 at the time the control of the present embodiment is performed, can be reduced. Therefore, parts, such as the developing roller 17, and the toner can be prevented from excessive degradation caused by the rotation of the developing roller 17.

Further, when the control of bringing the developing roller 17 into contact with the photosensitive drum 1, such as that of the present embodiment, is performed, the amount of toner fogging on the photosensitive drum 1 may be increased by changing the bias applied to the developing roller 17 and the charging roller 2. As a result, the external additive forming the blocking layer is better supplied to the edge portion of the cleaning blade and the cleaning performance can be improved. The value of the applied bias may be determined such as to facilitate the occurrence of fogging, and this value may be larger or smaller, by the absolute value thereof, than the value during image formation which is adjusted to prevent the occurrence of fogging. As a specific example, when the application of a DC bias of −350 V to the developing roller 17 and a DC bias of −1050 V to the charging roller 2 during image formation is controlled according to the present embodiment, the DC bias of the developing roller 17 may be changed to −400 V.

(Embodiment 2)

The specific feature of Embodiment 2 of the present invention is that the period in which the developing roller 17 is caused to be in contact with the photosensitive drum 1 within the non-image-formation period is further increased over than in Embodiment 1. In the present embodiment, the developing roller contact time is extended such that the developing roller 17 is brought into contact with the photosensitive drum 1 both before and after image formation. More specifically, the present embodiment is configured such that a mode (first timing, third mode) with a late contact timing at which the developing roller 17 and the photosensitive drum 1 are brought into contact with each other and a mode (second timing, fourth mode) with an early contact timing can be selectively executed within the non-image-formation period immediately before image formation. In the present embodiment, the process of releasing the toner from the toner charging brush 11 is executed within the non-image-formation period immediately after image formation, but may be executed within the non-image-formation period immediately before image formation. In this case, the contact timing in the mode with an early contact timing is set to be reached before the release process is executed. Further, the present embodiment is configured such that a mode (third timing, fifth mode) with an early separation timing at which the developing roller 17 and the photosensitive drum 1 are separated from each other and a mode (fourth timing, sixth mode) with a late separation timing can be selectively executed within the non-image-formation period immediately after image formation. The later separation timing is set to be reached after the process of releasing the toner from the toner charging brush 11 has ended. Other features are the same as in Embodiment 1. The components common to Embodiment 1 and Embodiment 2 are assigned with the same reference numerals, and the explanation thereof is herein omitted. Items which are not explained in Embodiment 2 are the same as in Embodiment 1.

With such a configuration of the present embodiment, the occurrence of vertical black stripe images caused by faulty cleaning can be prevented even when the secondary untransferred toner is collected from the intermediate transfer belt 5 within the non-image-formation period before image formation and after image formation. Further, in the present embodiment, the image forming portions in which the developing roller 17 is brought into contact include not only the first image forming portion in which the secondary untransferred toner is collected, but also the second and third image forming portions in which the developing rollers 17M and 17C are also brought into contact. This is because in the present embodiment, the drive motor and contact-separation mechanism of the developing roller 17 are shared by the first, second, and third image forming portions. However, the present invention is not limited to such a configuration, and the effect of the present invention can be demonstrated, provided that at least the developing roller 17 of the image forming portion in which the secondary untransferred toner is collected is brought into contact with the photosensitive drum 1 in order to prevent the occurrence of faulty cleaning. Therefore, in the present embodiment, a plurality of image forming portions are divided into image forming portions of two types. Thus, there are an image forming portion (fifth timing, first image forming portion) with a late contact timing of the developing roller 17 and the photosensitive drum 1 within the non-image-formation period immediately before image formation and an image forming portion (sixth timing, second image forming portion) with an early contact timing. Likewise, there are an image forming portion (eighth timing, second image forming portion) with a late separation timing of the developing roller 17 and the photosensitive drum 1 within the non-image-formation period immediately after image formation and an image forming portion (seventh timing, first image forming portion) with an early separation timing.

Figure 6:
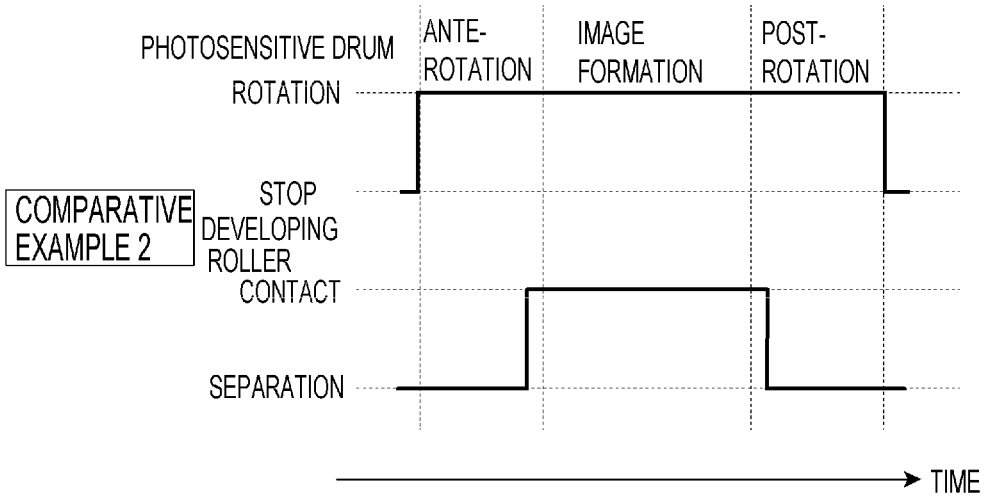
FIG. 6 is an explanatory drawing illustrating the developing roller contact and separation timing in Embodiment 2 and Comparative Example 2.
Figure 6:
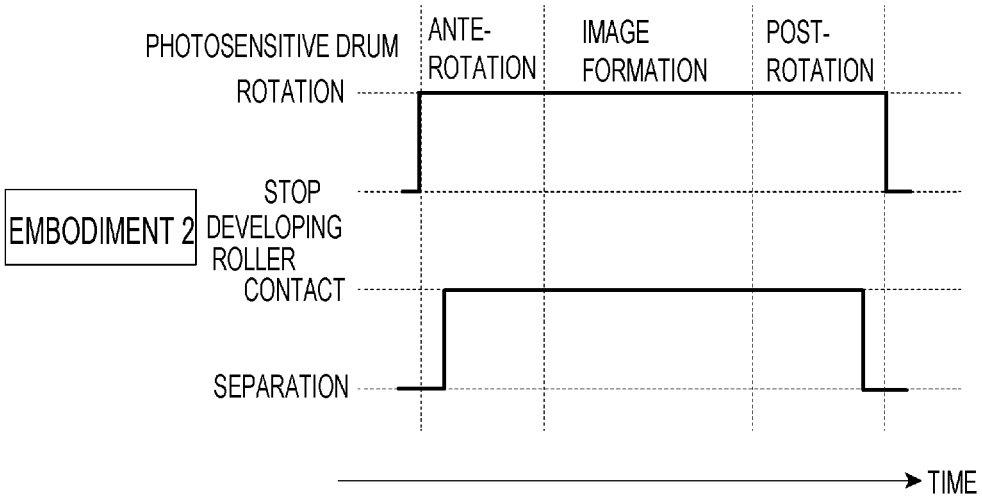

The cleaning performance was compared when actually performing the release process. FIG. 6 shows the timings at which the developing roller 17 and the photosensitive drum 1 are brought into contact and separated in Comparative Example 2 and Embodiment 2. In Comparative Example 2, the developing roller 17 is brought into contact with the photosensitive drum 1 immediately before image formation is started and the developing roller 17 and the photosensitive drum 1 are separated immediately after image formation. Meanwhile, in Embodiment 2, the developing roller 17 is brought into contact with the photosensitive drum 1 as soon as the rotation of the photosensitive drum is started, and the developing roller 17 and the photosensitive drum 1 are separated immediately before the rotation of the photosensitive drum 1 is stopped.

As common conditions, image defects (vertical black stripes) were checked when a four-color overlap image with a printing ratio of 50% of each color was continuously printed 10 times, and a yellow half-tone image with a printing ratio of 25% was printed immediately thereafter. The installation environment of the image forming apparatus 100 was a low-temperature low-humidity environment (temperature 15° C., humidity 10%) which was severe in terms of faulty cleaning.

TABLE 2

Faulty cleaning results in ante-rotation and post-rotation process

| | Contact state of developing roller and photosensitive drum | Occurrence of vertical black stripes caused by faulty cleaning |
|---|---|---|
| Comparative Example 2 | Separation | Yes |
| Embodiment 2 | Contact | No |

As indicated in Table 2, vertical black stripes caused by faulty cleaning appeared in Comparative Example 2, but in the configuration of Embodiment 2, no faulty cleaning has occurred. The reason why no faulty cleaning has occurred in the configuration of Embodiment 2 is the same as in Embodiment 1, and the explanation thereof is herein omitted. Increasing the time of contact of the developing roller 17 with the photosensitive drum 1 can easily be effective because a sufficient blocking layer can be produced. In particular, the effect of the present embodiment can be readily demonstrated when the external additive from the developing roller 17 is supplied to the cleaning blade 6 until before the secondary untransferred toner from the intermediate transfer belt 5 is collected by the cleaning blade 6 before image formation and after image formation.

As explained hereinabove, with the configuration of the present embodiment, the occurrence of a vertical black stripe image caused by faulty cleaning can be prevented even when the toner is collected during ante-rotation and post-rotation.

Whether or not to provide the operation panel (operation portion) 24 (see FIG. 1), which allows the user to set (control) the operation contents of the image forming apparatus, on the apparatus main body and to perform the control of bringing the developing roller 17 into contact, as in the present embodiment, may be selected by the user. By performing the control of bringing the developing roller 17 into contact with the photosensitive drum 1 only when the user has recognized an image caused by faulty cleaning, it is possible to prevent parts, such as the developing roller 17, and the toner from excessive degradation caused by the rotation of the developing roller 17.

Further, a temperature sensor (temperature detection portion) 22 (see FIG. 1) that detects the temperature at the location of the image forming apparatus may be provided at the apparatus main body, and the control of bringing the developing roller 17 into contact with the photosensitive drum 1 may be performed only when it is detected that the image forming apparatus 100 is at a temperature equal to or lower than a predetermined temperature. Faulty cleaning is liable to occur in a low-temperature environment in which the rubber elastic modulus of the cleaning grade decreases and the ability of the cleaning blade to follow the photosensitive drum is degraded. Therefore, by performing the control of the present embodiment, for example, only when a temperature of 20° C. or less is detected, can prevent parts, such as the developing roller 17, and the toner from excessive degradation caused by the rotation of the developing roller 17.

Further, when the control of bringing the developing roller 17 into contact with the photosensitive drum 1, such as that of the present embodiment, is performed, the rotation speed of the developing roller 17 may be decreased to be equal, for example, to that of the photosensitive drum 1. As a result, the rotation speed of the developing roller 17 at the time the control of the present embodiment is performed, can be reduced. Therefore, parts, such as the developing roller 17, and the toner can be prevented from excessive degradation caused by the rotation of the developing roller 17.

Further, when the control of bringing the developing roller 17 into contact with the photosensitive drum 1, such as that of the present embodiment, is performed, the amount of toner fogging on the photosensitive drum 1 may be increased by changing the bias applied to the developing roller 17 and the charging roller 2. As a result, the external additive forming the blocking layer is better supplied to the edge portion of the cleaning blade and the cleaning performance can be improved. The value of the applied bias may be determined such as to facilitate the occurrence of fogging, and this value may be larger or smaller, by the absolute value thereof, than the value during image formation which is adjusted to prevent the occurrence of fogging. As a specific example, when the application of a DC bias of −350 V to the developing roller 17 and a DC bias of −1050 V to the charging roller 2 during image formation is controlled according to the present embodiment, the DC bias of the developing roller 17 may be changed to −400 V.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-071911, filed Mar. 31, 2015, which is hereby incorporated by reference herein in its entirety.

What is claimed is:

1. An image forming apparatus, comprising:

a developer bearing member that bears developer to which externally added particles have been added;

an image bearing member that is in contact with the developer bearing member and on which an electrostatic latent image formed on a surface of the image bearing member is developed;

an intermediate transfer member to which a developer image developed on the surface of the image bearing member is transferred; and a cleaning member that is in contact with the image bearing member and cleans the surface of the image bearing member, wherein the developer bearing member and the image bearing member are configured to be separable in a non-image-formation period in which the development of the electrostatic latent image is not performed, wherein a cleaning operation, in which the developer borne by the intermediate transfer member is transferred to the image bearing member and removed from the surface of the image bearing member with the cleaning member, is executable in the non-image-formation period, wherein the image bearing member is in contact with the developer bearing member and the intermediate transfer member at least within a period in which the cleaning operation is executed within the non-image-formation period, wherein a first mode, in which the developer bearing member and the image bearing member are not brought into contact with each other, and a second mode, in which the developer bearing member and the image bearing member are brought into contact with each other, are selectively executable in a period in which the cleaning operation is executed, and wherein the second mode is executed at least within the non-image-formation period immediately after an image formation period in which the development of the electrostatic latent image is performed.

2. The image forming apparatus according to claim 1, further comprising a charging member for charging the developer borne by the intermediate transfer member, wherein in the cleaning operation, the charging member charges the developer borne by the intermediate transfer member with a polarity opposite to a charging polarity of the developer during image formation of developing the electrostatic latent image.

3. The image forming apparatus according to claim 2, wherein the cleaning operation includes a release step of releasing the developer held by the charging member to the intermediate transfer member.

4. The image forming apparatus according to claim 3, wherein in the release step, the charging member applies a voltage of the same polarity as the charging polarity of the developer during the image formation.

5. The image forming apparatus according to claim 1, wherein the externally added particles are supplied to a contact portion of the cleaning member, which is in contact with the image bearing member, as a result of the developer bearing member being in contact with the image bearing member at least within a period in which the cleaning operation is executed within the non-image-formation period.

6. The image forming apparatus according to claim 5, wherein a layer of the externally added particles is formed on the contact portion as a result of supplying the externally added particles to the contact portion.

7. The image forming apparatus according to claim 1, wherein the cleaning member is a blade member in which a tip extending in a direction opposite to a direction of movement of the image bearing member with respect to the cleaning member is in contact with the surface of the image bearing member.

8. The image forming apparatus according to claim 1, wherein a period in which the developer bearing member and the image bearing member are separated from each other is present before and after a period in which the cleaning operation is executed.

9. The image forming apparatus according to claim 1, wherein a third mode, in which a contact timing, at which the developer bearing member and the image bearing member are brought into contact with each other, is a first timing, and a fourth mode, in which the contact timing is a second timing, which is earlier than the first timing, are selectively executable in the non-image-formation period immediately before an image formation period in which the development of the electrostatic latent image is performed, and wherein when the fourth mode is executed, the cleaning operation is executed after the second timing.

10. The image forming apparatus according to claim 1, wherein a third mode, in which a separation timing, at which the developer bearing member and the image bearing member are separated from each other, is a first timing, and a fourth mode, in which the separation timing is a second timing, which is later than the first timing, are selectively executable in the non-image-formation period immediately after an image formation period in which the development of the electrostatic latent image is performed, and wherein when the fourth mode is executed, the cleaning operation is executed before the second timing is reached.

11. The image forming apparatus according to claim 1, further comprising a plurality of image forming portions each including the developer bearing member, the image bearing member, and the cleaning member, wherein in at least one image forming portion from among the plurality of the image forming portions, the image bearing member is in contact with the developer bearing member and the intermediate transfer member at least within a period in which the cleaning operation is executed within the non-image-formation period.

12. The image forming apparatus according to claim 11, wherein the plurality of the image forming portions includes a first image forming portion and a second image forming portion, and wherein in the non-image-formation period immediately before an image formation period in which the development of the electrostatic latent image is performed:

the developer bearing member and the image bearing member of the first image forming portion are in contact with each other at a first timing, and the developer bearing member and the image bearing member of the second image forming portion are in contact with each other at a second timing which is earlier than the first timing.

13. The image forming apparatus according to claim 12, wherein the second image forming portion is the image forming portion which is the closest to the charging member in the movement direction of the intermediate transfer member, from among the plurality of the image forming portions.

14. The image forming apparatus according to claim 11, wherein the plurality of the image forming portions includes a first image forming portion and a second image forming portion, and wherein in the non-image-formation period immediately after an image formation period in which the development of the electrostatic latent image is performed:

the developer bearing member and the image bearing member of the first image forming portion are separated from each other at a first timing, and the developer bearing member and the image bearing member of the second image forming portion are separated from each other at an second timing which is later than the first timing.

15. The image forming apparatus according to claim 1, further comprising an operation portion that enables a user to set operation contents of the image forming apparatus, wherein when set by the user, an operation of bringing the image bearing member into contact with the developer bearing member and the intermediate transfer member is executed at least within a period in which the cleaning operation is executed within the non-image-formation period.

16. The image forming apparatus according to claim 1, further comprising a temperature detection portion, wherein when a temperature detected by the temperature detection portion is equal to or less than a predetermined temperature, the image bearing member comes into contact with the developer bearing member and the intermediate transfer member at least within a period in which the cleaning operation is executed within the non-image-formation period.

17. The image forming apparatus according to claim 1, wherein a rotation speed of the developer bearing member and a rotation speed of the image bearing member are the same speed when the image bearing member is in contact with the developer bearing member and the intermediate transfer member at least within a period in which the cleaning operation is executed within the non-image-formation period.

18. The image forming apparatus according to claim 1, wherein for the developer bearing member, a rotation speed when the image bearing member is in contact with the developer bearing member and the intermediate transfer member at least within a period in which the cleaning operation is executed within the non-image-formation period is lower than a rotation speed during image formation of developing the electrostatic latent image.

19. The image forming apparatus according to claim 1, further comprising a charging member for charging the developer borne by the intermediate transfer member, wherein when the image bearing member is in contact with the developer bearing member and the intermediate transfer member at least within a period in which the cleaning operation is executed within the non-image-formation period, a bias applied to the developer bearing member and the charging member differs in magnitude from that during image formation of developing the electrostatic latent image.

* * * * *